US007574861B2

(12) United States Patent
Niiyama et al.

(10) Patent No.: US 7,574,861 B2
(45) Date of Patent: Aug. 18, 2009

(54) EXTERNAL COMBUSTION ENGINE

(75) Inventors: Yasunori Niiyama, Kuwana (JP); Shinichi Yatsuzuka, Nagoya (JP); Takashi Kaneko, Nagoya (JP); Shuzo Oda, Kariya (JP); Katsuya Komaki, Kariya (JP)

(73) Assignee: DENSO Corporation, Kariya (JP)

( * ) Notice: Subject to any disclaimer, the term of this patent is extended or adjusted under 35 U.S.C. 154(b) by 129 days.

(21) Appl. No.: 11/973,364

(22) Filed: Oct. 5, 2007

(65) Prior Publication Data

US 2008/0178595 A1 Jul. 31, 2008

(30) Foreign Application Priority Data

Jan. 31, 2007 (JP) ..... 2007-020631

(51) Int. Cl.
*F02G 1/04* (2006.01)
*F01K 23/06* (2006.01)
*F02C 5/00* (2006.01)

(52) U.S. Cl. ..... 60/531; 60/508; 60/670; 60/39.6

(58) Field of Classification Search ..... 60/508, 60/514, 517, 531, 659, 670; 251/190
See application file for complete search history.

(56) References Cited

U.S. PATENT DOCUMENTS 4,195,481 A * 4/1980 Gregory ..... 60/516
4,584,840 A * 4/1986 Baumann ..... 62/6
2005/0257524 A1 11/2005 Yatsuzuka et al.

FOREIGN PATENT DOCUMENTS

JP 2005-330885 12/2005
JP 2006-74351 3/2006

OTHER PUBLICATIONS

U.S. Appl. No. 11/717,794, filed Mar. 13, 2007, Oda et al.

* cited by examiner

*Primary Examiner*—Thomas E Denion
*Assistant Examiner*—Christopher Jetton
(74) *Attorney, Agent, or Firm*—Harness, Dickey & Pierce, PLC

(57) ABSTRACT

An external combustion engine formed with a plurality of heaters for improving output, provided with a container in which a working medium is sealed flowable in a liquid state, the container being formed with heaters for heating part of a working medium to generate vapor of the working medium and coolers for cooling the vapor to liquefy, the generation and liquefaction of the vapor causing the working medium to change in volume and the displacement of the liquid part of the working medium caused by the change in volume of the working medium being converted to mechanical energy for output, wherein at least the parts of the container connected with the heaters being branched into pluralities of tubular parts, a plurality of heaters are formed so as to be connected with the plurality of tubular parts, a plurality of vapor reservoirs for storing the vapor of the working medium are formed so as to be connected with the plurality of heaters, and the plurality of vapor reservoirs are connected with each other.

8 Claims, 5 Drawing Sheets

EXTERNAL COMBUSTION ENGINE

BACKGROUND OF THE INVENTION

1. Field of the Invention

The present invention relates to an external combustion engine converting the displacement of a liquid part of a working medium occurring due to generation of vapor of the working medium and a change in volume of the working medium accompanying liquefaction to mechanical energy for output.

2. Description of the Related Art

In the past, as one external combustion engine, an engine configured formed with a heater for heating part of a working medium in a container in which the working medium is sealed flowable in the liquid state so as to generate vapor of the working medium and a cooler for cooling the vapor of the working medium to liquefy it, to change the volume of the working medium along with this generation and liquefaction of the vapor of the working medium, and to take out the displacement of the liquid part of the working medium occurring due to the change in volume of the working medium as mechanical energy is disclosed in Japanese Patent Publication (A) No. 2005-330885.

In this related art, the portion connecting the heater and cooler in the container is split into a plurality of tubular parts so as to form in effect a plurality of heaters and coolers corresponding to the plurality of tubular parts and thereby increase the heat transfer areas of the heater and cooler. Due to this, the working medium is improved in heating performance and cooling performance and the output of the external combustion engine is improved.

Here, if forming a plurality of heaters corresponding to the plurality of tubular parts, the timing of generation of vapor of the working medium (timing of rise in pressure) will end up differing for each tubular part. For this reason, the internal pressure of the slow vapor generation timing tubular parts will become higher than the internal pressure of the fast vapor generation timing tubular parts and a pressure difference will occur between the plurality of tubular parts.

For this reason, if the vapor of the working medium increases in volume and the liquid part of the working medium displaces, part of the liquid part of the working medium will end up displacing from the slow vapor generation timing tubular part to the fast vapor generation timing tubular part side and will not displace toward the output part. As a result, the problem arises that part of the displacement of the liquid part of the working medium cannot be effectively taken out as mechanical energy and the efficiency of the external combustion engine ends up falling.

As a measure to deal with this problem, in the related art, the plurality of heaters are connected with each other. Due to this, even if the timing of generation of vapor of the working medium differs between the plurality of tubular parts, the internal pressures of the plurality of tubular parts can be made the same pressure, so a difference in internal pressures between the plurality of tubular parts can be avoided.

For this reason, it is possible to prevent part of the liquid part of the working medium from ending up displacing from the slow vapor generation timing tubular part side to the fast vapor generation timing tubular part side, so a drop in the efficiency of the external combustion engine can be suppressed.

However, according to detailed studies of the present inventors, it was learned that there is room for further improvement of the output of the external combustion engine of this related art in the following point. That is, in this related art, since a plurality of heaters are connected, the vapor of the working medium moves from the slow vapor generation timing tubular parts to the fast vapor generation timing tubular parts.

This being the case, the vapor of the working medium moving to the fast vapor generation timing tubular parts ends up becoming mixed with the liquid part of the working medium in the fast vapor generation timing tubular parts and forming bubbles. If the vapor of the working medium mixes with the liquid part of the working medium and forms bubbles in this way, it is learned that the vapor of the working medium ends up being cooled by the liquid part of the working medium and liquefies, so the amount of displacement of the liquid part of the working medium ends up being reduced by that amount and the output of the external combustion engine ends up falling.

SUMMARY OF THE INVENTION

The present invention was made in consideration with the above point and has as its object to improve the output in an external combustion engine formed with a plurality of heaters corresponding to a plurality of tubular parts. Note that the reference notations in parentheses for the means described in this section show the correspondence with the specific means described in the later explained embodiments.

To achieve the above object, the present invention provides an external combustion engine provided with a container (11) in which a working medium (12) is sealed flowable in a liquid state, the container (11) being formed with a heater (17) for heating part of a working medium (12) to generate vapor of the working medium (12) and a cooler (19) for cooling the vapor to liquefy, the generation and liquefaction of the vapor causing the working medium (12) to change in volume and the displacement of the liquid part of the working medium (12) caused by the change in volume of the working medium (12) being converted to mechanical energy for output, wherein at least the part of the container (11) connected with the heater (17) is branched into a plurality of tubular parts (11*c*), a plurality of heaters (17) are formed so as to be connected with the plurality of tubular parts (11*c*), a plurality of vapor reservoirs (22) for storing the vapor of the working medium (12) are formed so as to be connected with the plurality of heaters (17), and the plurality of vapor reservoirs (22) are connected with each other.

According to this, since a plurality of tubular parts (11*c*) can be connected with each other through the vapor reservoirs (22), even if the timing of generation of vapor of the working medium (12) differs between the plurality of tubular parts (11*c*), a difference in internal pressure arising between the plurality of tubular parts (11*c*) can be avoided and a drop in the efficiency of the external combustion engine can be suppressed.

Further, since the plurality of tubular parts (11*c*) are connected through the vapor reservoirs (22), the vapor of the working medium (12) in the vapor reservoirs (22) of the slow vapor generation timing tubular part (11*c*) side moves to the vapor reservoirs (22) of the fast vapor generation timing tubular part (11*c*) side.

That is, since the plurality of heaters (17) are directly connected together, movement of the vapor of the working medium (12) at the slow vapor generation timing tubular part (11*c*) side to the inside of the heaters (17) of the fast vapor generation timing tubular part (11*c*) side can be avoided.

For this reason, the vapor of the working medium (12) moving from the slow vapor generation timing tubular part (11*c*) side to the fast vapor generation timing tubular part (11*c*) side mixing with the liquid part of the working medium (12) and forming bubbles can be avoided. As a result, the vapor of the working medium (12) ending up being cooled by the liquid part of the working medium (12) and being liquefied can be suppressed, so the amount of displacement of the liquid part of the working medium (12) ending up being reduced can be suppressed and the output of the external combustion engine can be improved.

The present invention specifically can reduce the number of parts and can reduce the cost if forming the heaters (17) and the vapor reservoirs (22) in a single block member (13).

Further, the present invention specifically has the plurality of heaters (17) arranged in the horizontal direction, the plurality of vapor reservoirs (22) arranged above the plurality of heaters (17), and a connecting passage (26) connecting the plurality of vapor reservoirs (22) extending in the horizontal direction between the plurality of vapor reservoirs (22).

Due to this, the spaces between the plurality of vapor reservoirs (22) can be utilized to connect the plurality of vapor reservoirs (22), so the increase in the size of the external combustion engine accompanying the connection of the plurality of vapor reservoirs (22) can be avoided.

In this regard, the assignee previously proposed in Japanese Patent Application No. 2006-74351 (hereinafter referred to as the "related application") an external combustion engine improving the heat transfer rate from the heater to the working medium. In this related application, the heater is formed so that when the vapor of the working medium is decreased in volume and the liquid part of the working medium displaces from the cooler side to the heater side, the liquid part of the working medium strikes the inner wall surface of the heater (collision surface).

More specifically, as shown in FIG. 4 of the related application, the heater is comprised of a first path portion extending in a tubular shape at the side near the cooler and a second path portion sticking out in a ring shape in a direction perpendicular to the first path portion from the end of the first path portion at the side away from the cooler. The end face of the first path portion at the side away from the cooler forms the collision surface of the liquid part of the working medium.

According to this, the liquid part of the working medium strikes the collision surface, whereby the liquid part of the working medium is agitated and turbulence is formed, so a thermal boundary layer formed inside the heater is destroyed and the heat transfer rate from the heater to the working medium is improved.

However, in this related application, the vapor reservoir storing the vapor of the working medium is connected with part of the heater away from the collision surface. More specifically, the vapor reservoir is communicated with the part of the heater at the outer periphery of the second path portion.

For this reason, if the vapor of the working medium generated at the collision surface of the heater does not pass through the second path portion, it cannot be stored in the vapor reservoir. That is, the vapor of the working medium generated at the collision surface of the heater is not smoothly led to the vapor reservoir.

As a result, it is learned that the vapor of the working medium generated at the collision surface of the heater ends up mixing with the liquid part of the working medium and forming bubbles and ends up being cooled and liquefied by the liquid part of the working medium, so the amount of displacement of the liquid part of the working medium is reduced by that amount and the output of the external combustion engine ends up falling.

Considering this point, the present invention provides a container (11) in which a working medium (12) is sealed flowable in a liquid state, the container (11) being formed with heaters (17) for heating part of a working medium (12) to generate vapor of the working medium (12) and coolers (19) for cooling the vapor to liquefy, the generation and liquefaction of the vapor causing the working medium (12) to change in volume and the displacement of the liquid part of the working medium (12) caused by the change in volume of the working medium (12) being converted to mechanical energy for output, wherein each heater (17) has a vapor reservoir (22) storing vapor arranged at it, each heater (17) has a collision surface (20*a*) which the liquid part of the working medium (12) strikes when the volume of the vapor is reduced and the liquid part of the working medium (12) displaces from the cooler (19) side toward the heater (17) side formed at it, and each vapor reservoir (22) is connected with the portion of the heater (17) where the collision surface (20*a*) is formed.

According to this, each heater (17) and vapor reservoir (22) are connected by the vapor passage (23), and the end of the vapor passage (23) at the heater (17) side is arranged at the collision surface (20*a*), so the vapor of the working medium (12) generated at the collision surface (20*a*) can be released quickly through the vapor passage (23) to the vapor reservoir (22).

For this reason, the vapor of the working medium (12) generated at the collision surface (20*a*) ending up mixing with the liquid part of the working medium (12) and being liquefied can be suppressed, so the amount of displacement of the liquid part of the working medium (12) ending up being reduced can be suppressed and the output of the external combustion engine can be improved.

The present invention specifically can connect each heater (17) and vapor reservoir (22) by the vapor passage (23).

Further, in the present invention, specifically each heater (17) is formed by a first path portion (20) extending toward the cooler (19) side and a second path portion (21) extending from an end of the first path portion (20) at the opposite side to the cooler (19) in a direction perpendicular to the direction in which the first path portion (20) extends, the collision surface (20*a*) is formed at the end of the first path portion (20) and the opposite side from the cooler (19), the vapor reservoir (22) is arranged at the opposite side of the first path portion (20) from the cooler (19), and the passage (23) connecting the heater (17) and the vapor reservoir (22) extends in parallel between the collision surface (20*a*) and vapor reservoir (22) in the direction in which the first path portion (20) extends.

Due to this, the direction by which the liquid part of the working medium (12) strikes the collision surface (20*a*) and the direction by which the vapor passage (23) extends can be made the same direction and the vapor of the working medium (12) can be released to the vapor reservoir (22) more quickly through the vapor passage (23). As a result, the vapor of the working medium (12) generated at the collision surface (20*a*) ending up mixing with the liquid part of the working medium (12) can be suppressed more, so the output of the external combustion engine can be improved more.

Further, in the present invention, specifically, the inside diameter (D) of the passage (23) connecting each heater (17) and vapor reservoir (22) is set smaller than the inside diameter (D) of the first path portion (20).

According to this, even if arranging the end of the vapor passage (23) at the heater (17) side at the collision surface (20*a*), the collision surface (20*a*) can be secured at exactly the predetermined area, so the effect of the collision surface (20*a*) in improving the heat transfer rate from the heater (17) to the working medium (12) can be exhibited without problem.

Further, in the present invention, specifically, the passage (23) connecting each heater (17) and vapor reservoir (22) can be comprised of a large number of thin tubes.

BRIEF DESCRIPTION OF THE DRAWINGS

These and other objects and features of the present invention will become clearer from the following description of the preferred embodiments given with reference to the attached drawings, wherein:

FIG. 3A is a schematic view of the configuration of a power generating unit showing a second embodiment of the present invention, while

FIG. 4A is a schematic view of the configuration of a power generating unit showing a third embodiment of the present invention, while FIG. 5A is a schematic view of the configuration of a power generating unit showing a fourth embodiment of the present invention, while

SUMMARY OF THE INVENTION

First Embodiment

Below, a first embodiment of the present invention will be explained with reference to FIG. 1 and FIG. 2. The embodiment uses the external combustion engine of the present invention for a power generating unit.

Figure 1:
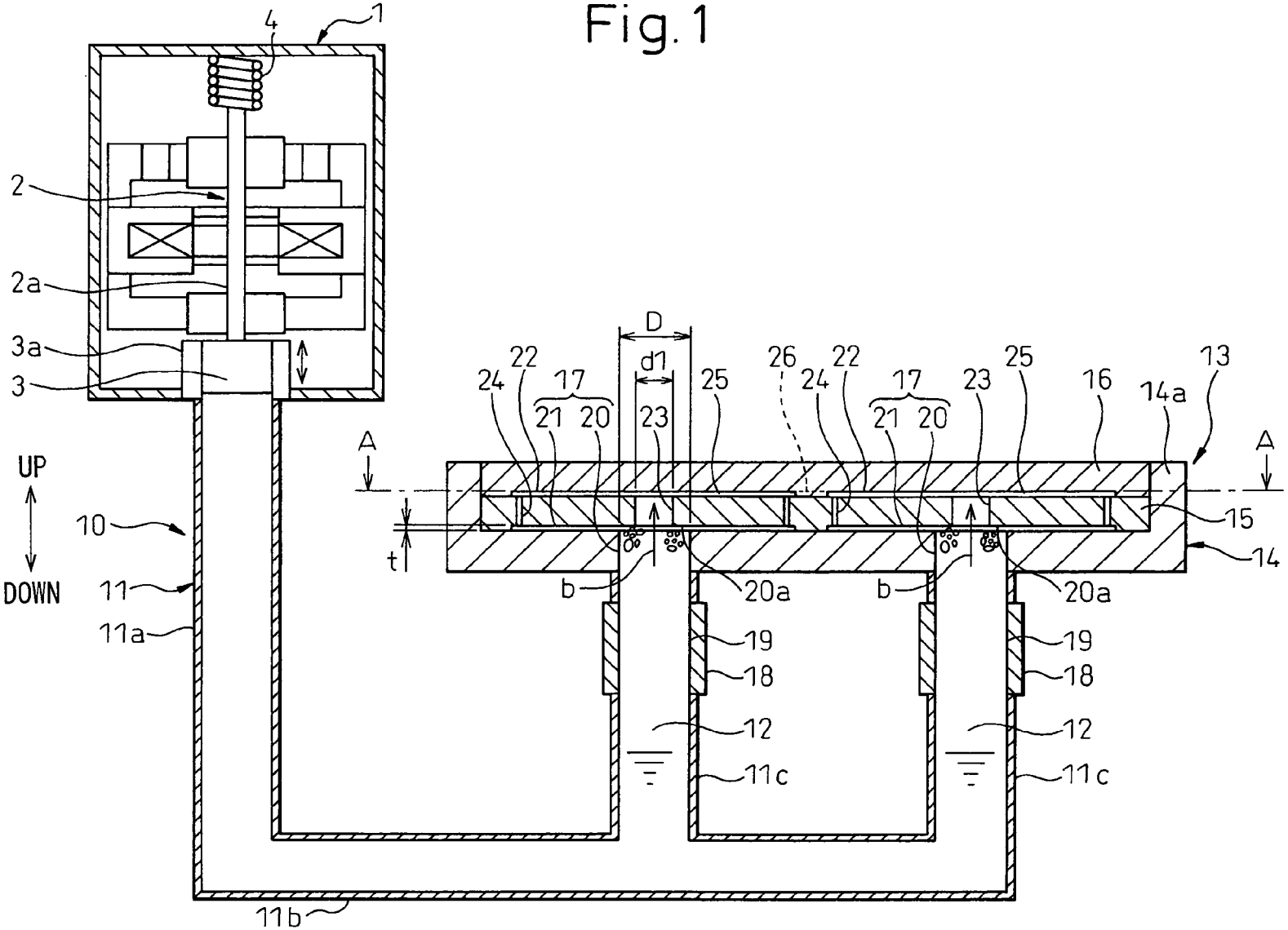
FIG. 1 is a schematic view of the configuration of a power generating unit showing a first embodiment of the present invention.
Figure 2:
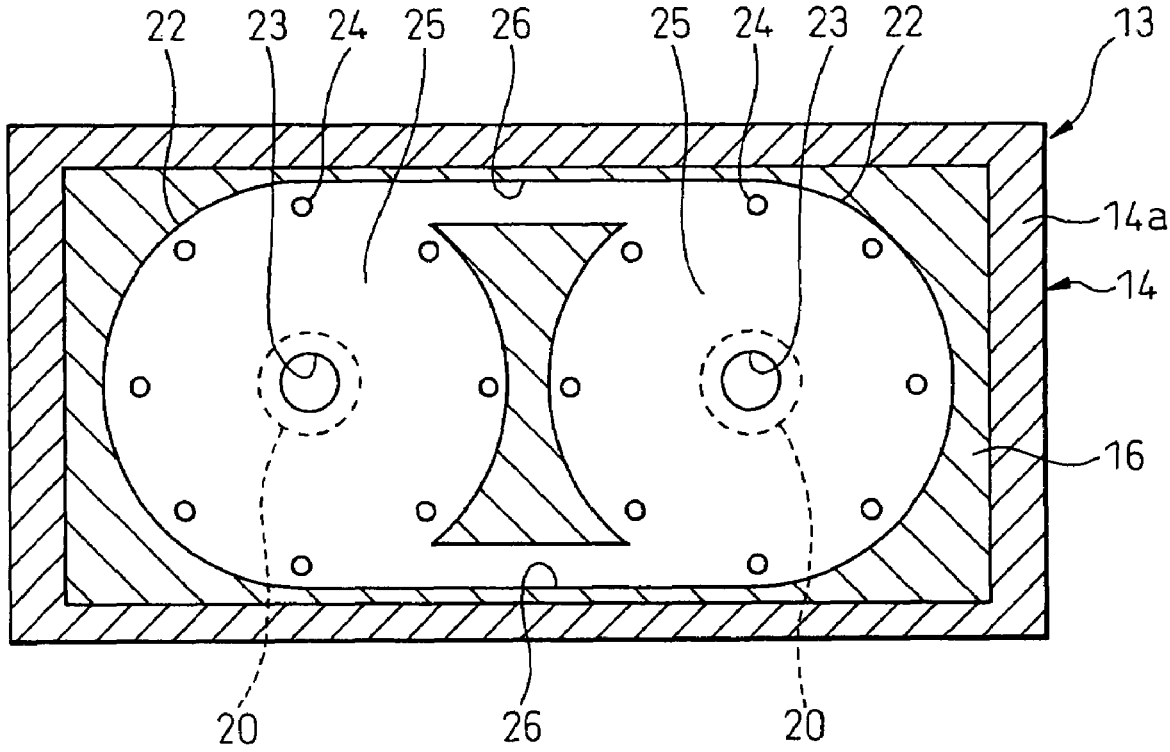
FIG. 2 is a cross-sectional view along the line A-A of FIG. 1.

FIG. 1 is a view of the configuration showing the general configuration of a power generating unit according to the present embodiment. The up and down arrows in FIG. 1 show the vertical direction in the installed state of the external combustion engine.

The power generating unit according to the present embodiment is comprised of an external combustion engine 10 and a generator 1. The generator 1 generates electromotive force by vibration and displacement of a movable element 2 in which permanent magnets are buried and is driven by the external combustion engine 10.

The external combustion engine 10 is provided with a container 11 in which a working medium (in this example, water) 12 is sealed flowable in a liquid state. The container 11 is a pressure container mainly formed in a tubular shape and has a first tubular part 11*a* extending from the generator 1 downward, a second tubular part 11*b* extending in the horizontal direction from the bottom end of the first tubular part 11*a*, and two third tubular parts 11*c* extending upward branched from the second tubular part 11*b*. Note that the two third tubular parts 11*c* correspond to the plurality of tubular parts in the present invention.

The top end parts of the two third tubular parts 11*c* are connected by a thin rectangular parallelopiped shaped block member 13. This block member 13 forms part of the container 11 and is formed from copper, aluminum, etc. superior in heat conductivity. In this example, due to circumstances in shaping, the block member 13 is formed split into rectangular plate-shaped first to third split members 14 to 16. Further, these first to third split members 14 to 16 are fastened together by screws or other fastening means in the stacked state.

The outer circumference of the first split member 14 arranged adjacent to the top ends of the third tubular parts 11*c* among the first to third split members 14 to 16 is formed with a frame shaped part 14*a* abutting against the outer circumferential end faces of the second and third split members 15, 16.

Inside the block member 13, two hollow parts communicating with the two third tubular parts 11*c* are formed. These hollow parts form the heaters 17. The heaters 17 use an external heat source to heat the working medium 12 and generate vapor of the working medium 12. Details will be explained later.

The middle parts 18 in the longitudinal directions of the two third tubular parts 11*c* are respectively formed from copper or aluminum having superior heat conductivities. The spaces inside the middle parts 18 form coolers 19. The coolers 19 function to cool and liquefy the vapor of the working medium 12 generated by the heaters 17.

In the present example, cooling water is circulated to the hollow parts 18 of the third tubular parts 11*c*, whereby the coolers 19 cool the vapor of the working medium 12. In the circulation circuit of the cooling water, a radiator (not shown) is arranged. The heat which the cooling water robs from the vapor of the working medium 12 is designed to be discharged to the atmosphere by the radiator.

Note that in the container 11, the portions other than the block member 13 and the middle parts 18 of the third tubular parts 11*c* are formed by stainless steel superior in heat insulating property.

On the other hand, at the top end of the first tubular part 11*a* in the container 11, a piston 3 displacing by receiving pressure from the liquid part of the working medium 12 is arranged slidable with a cylinder part 3*a*. Note that the piston 3 is connected to a shaft 2*a* of a movable element 2. At the opposite side from the piston 3 across the movable element 2, a spring 4 forming an elastic means for generating elasticity for pushing the movable element 2 to the piston 3 side is provided.

Next, details of the heaters 17 will be explained. The two heaters 17 in this example are designed to be heated by high temperature gas. Inside them, there are first and second path portions 20, 21.

Among the first and second path portions 20, 21 of each heater, the first path portion 20 arranged at the side close to the cooler 19 has a cylindrical shape coaxial with the third tubular part 11*c*. Further, among the first and second path portions 20, 21, the second path portion 21 arranged at the side away from the cooler 19 is shaped sticking out in a ring to the outside of the first path portion 20 in the radial direction from the end at the opposite side from the cooler 19 in the first path portion 20 (top end in FIG. 1).

Due to this, the top end face 20*a* of the first path portion 20 forms a collision surface which the liquid part of the working medium 12 collides with when the vapor of the working medium 12 is decreased in volume and the liquid part of the working medium 12 displaces from the cooler 19 side (bottom side in FIG. 1) to the heater 17 side (top side of FIG. 1).

In this example, the thickness dimension t (vertical direction dimension of FIG. 1) of the second path portion 21 is set smaller than the inside diameter D of the first path portion 20 (t<D). Further, by setting the thickness dimension t of the second path portion 21 to the heat penetration depth σ or less (t<σ), the working medium 12 can be heated well at the second path portion 21.

Here, the heat penetration depth σ is an indicator expressing how far a temperature change is transmitted when the working medium 12 in the second path portion 21 cyclically changes in temperature. Specifically, the heat penetration depth σ is an indicator of the distribution of the change in entropy in the thickness direction of the second path portion 21 determined by the thermal diffusivity a (m/s) and the angular frequency ω (rad/s) as expressed by the following equation (1):

$$\sigma=\sqrt{(2\cdot a/\omega)} \quad (1)$$

Note that the thermal diffusivity a is the value of the heat conductivity of the working medium 12 divided by the specific heat and density of the working medium 12.

Inside the block member 13 above each heater 17, a space for storing the vapor of the working medium 12 generated by the heater 17, that is, a vapor reservoir 22, is formed. This vapor reservoir 22 and heater 17 are connected by first and second vapor passages 23, 24. Note that the first vapor passage 23 corresponds to a "path" in the present invention.

In this example, each vapor reservoir 22 is comprised of a disk-shaped space facing the second path portion 21 separated by a predetermined distance in the heater 17 and is arranged coaxially with the second path portion 21. Further, the vapor reservoir 22 has a gas 25 of an added medium of a predetermined volume sealed inside it. As the added medium, it is possible to select a medium maintaining a gaseous state under the operating conditions of the external combustion engine. The gas 25 may for example be the easy handling air or pure vapor of the working medium 12.

The first vapor passage 23 is comprised of a single circular hole arranged at a top end face 20*a* of the first path portion 20 in the heater 17 and connects the portion of the heater 17 where the top end face 20*a* is formed and the center part of the vapor reservoir 22. The inside diameter d1 of the first vapor passage 23 is set to be less than the inside diameter d of the first path portion 20 (d1<D). In the present example, the first vapor passage 23 is arranged coaxially with the first path portion 20.

The second vapor passage 24 is comprised of a plurality of circular holes connecting the outer periphery of the second path portion 21 and the outer periphery of the vapor reservoir 22 in the heater 17. In this example, the plurality of holes of the second vapor passage 24 are arranged at equal intervals in the peripheral direction of the second path portion 21 and the vapor reservoir 22.

In this example, the volume of the working medium 12 sealed in the container 11 is set so that even when the vapor of the working medium 12 is most reduced in volume and the liquid level of the working medium 12 rises the highest, the liquid part of the working medium 12 will not enter the vapor reservoir 22.

More specifically, when the liquid level of the working medium 12 has risen the most, it is supposed to reach the top end face 20*a* of the first path portion 20. For this reason, when vapor of the working medium 12 is generated in each heater 17, the vapor of the working medium 12 first can flow through the second vapor passages 23, 24 into the vapor reservoir 22.

Each vapor reservoir 22 is formed inside the block member 13 in the same way as each heater 17, so the gas 25 in the vapor reservoir 22 is heated to substantially the same temperature as the temperature of the vapor of the working medium 12. Due to this, when the vapor of the working medium 12 enters the vapor reservoir 22, the vapor of the working medium 12 ending up being cooled inside the vapor reservoir 22 and liquefying is avoided.

Two vapor reservoirs 22, that is, the vapor reservoir 22 corresponding to one of the heaters 17 and the vapor reservoir 22 corresponding to the other of the heaters 17, are communicated by connecting passages 26 formed inside the block member 13. In this example, two connecting passage 26 are formed parallel to the long sides of the block member 13 (sides extending in left-right direction in FIG. 2) and contiguous with the disk shapes of the vapor reservoirs 22.

Next, briefly explaining the method forming the heaters 17, vapor reservoirs 22, first and second vapor passages 23, 24, and connecting passages 26 of the present embodiment, the first to third split members 14 to 16 of the block member 13 are cut with shapes corresponding to the heaters 17, vapor reservoirs 22, first and second vapor passages 23, 24, and connecting passages 26, then the first to third split members 14 to 16 are fastened together, whereby it is possible to form the heaters 17, vapor reservoirs 22, first and second vapor passages 23, 24, and connecting passages 26 inside the block member 13.

More specifically, the first split member 14 is processed to form through holes corresponding to the first path portions 20 of the heaters 17. The second split member 15 is processed to form circular recessed shapes corresponding to the second path portions 21 of the heaters 17 and through holes corresponding to the first and second vapor passages 23, 24. The third split members 16 are processed to form circular recessed shapes corresponding to the vapor reservoirs 22 and groove shapes corresponding to the connecting passages 26, then the first to third split members 14 to 16 are fastened together.

Next, the operation in the above constitution will be simply explained. First, when the working medium (water) 12 in the heater 17 is heated and vaporizes, the vapor reservoirs 22 and the heaters 17 store the high temperature and high pressure vapor of the working medium 12 and the level of the working medium 12 in the third tubular parts 11*c* is pushed down. This being so, the liquid part of the working medium 12 displaces to the first tubular part 11*a* side and pushes up the piston 3 of the generator 1 side.

Next, when the liquid level of the working medium 12 inside the third tubular parts 11*c* falls to the coolers 19 and the vapor of the working medium 12 enters the coolers 19, the vapor of the working medium 12 is cooled by the coolers 19 and liquefies. For this reason, the force pushing down the liquid level of the working medium 12 disappears, the liquid level of the working medium 12 rises, and the liquid part of the working medium 12 also rises. As a result, the piston 3 at the generator 1 side which was once pushed up by the expansion of the vapor of the working medium 12 descends.

By repeatedly executing this operation, the liquid part of the working medium 12 inside the container 11 cyclically displaces (so-called self vibration) and the movable element 2 of the generator 1 is made to cyclically move up and down.

That is, the generation and liquefaction of the vapor of the working medium 12 causes the working medium 12 to change in volume. The displacement of the liquid part of the working medium 12 occurring due to the change in the volume of the working medium 12 can be converted to mechanical energy for output. Note that the "volume of the working medium 12" referred to here means the total of the volume of the liquid part of the working medium 12 and the volume of the vapor of the working medium 12.

In the present embodiment, two third tubular parts 11*c* are provided and, corresponding to the two third tubular parts 11*c*, two heaters 17 and coolers 19 are formed, so the heat transfer area of the heaters 17 and coolers 19 can be increased. Due to this, the heating performance and cooling performance of the working medium 12 can be improved and the output of the external combustion engine can be improved.

Further, the two heaters 17 are connected through the first and second vapor passages 23, 24, the vapor reservoirs 22, and the connecting passages 26, so even if the timing of generation of the vapor of the working medium 12 differs between the two heaters 17, in other words, between the two third tubular parts 11*c*, the internal pressures of the two third tubular parts 11*c* can be made the same, so formation of a pressure difference between the two third tubular parts 11*c* can be avoided.

For this reason, when the timing of generation of the vapor of the working medium 12 deviates between the two third tubular parts 11*c*, part of the liquid part of the working medium 12 ending up displacing from the slow vapor generation timing third tubular part 11*c* side to the fast vapor generation timing third tubular part 11*c* side can be prevented, so a drop in efficiency of the external combustion engine can be suppressed.

Here, in the present embodiment, the two heaters 17 are not directly connected but are connected through the first and second vapor passages 23, 24, the vapor reservoirs 22, and the connecting passages 26. For this reason, if the timing of generation of the vapor of the working medium 12 differs between the two third tubular parts 11*c*, the vapor of the working medium 12 will move from the vapor reservoir 22 of the slow vapor generation timing third tubular part 11*c* side to the vapor reservoir 22 of the fast vapor generation timing third tubular part 11*c* side.

This being the case, the vapor of the working medium 12 moving from the vapor reservoir 22 of the slow vapor generation timing third tubular part 11*c* side to the vapor reservoir 22 of the fast vapor generation timing third tubular part 11*c* side mixes with the gas 25 sealed in the vapor reservoir 22 of the fast vapor generation timing third tubular part 11*c* side.

In other words, the vapor of the working medium 12 moving from the vapor reservoir 22 of the slow vapor generation timing third tubular part 11*c* side to the vapor reservoir 22 of the fast vapor generation timing third tubular part 11*c* side vapor mixing with the liquid part of the working medium 12 in the vapor reservoir 22 of the fast vapor generation timing third tubular part 11*c* side and forming bubbles can be suppressed.

For this reason, the vapor of the working medium 12 ending up being cooled and liquefied by the liquid part of the working medium 12 can be suppressed, so the amount of displacement of the working medium being reduced by the amount of liquefaction of the vapor of the working medium like in the above related art and the output of the external combustion engine ending up falling can be suppressed. That is, compared with the above related art, the output of the external combustion engine can be improved.

Note that in this example, two heaters 17 were arranged in the horizontal direction, two vapor reservoirs 22 were arranged above the two heaters 17, and connecting passages 26 were arranged in the horizontal direction between the two vapor reservoirs 22, so it is possible to utilize the space between the two vapor reservoirs 22 to connect the two vapor reservoirs 22.

Due to this, it is possible to keep the size of the external combustion engine from becoming larger along with connection of the two vapor reservoirs 22.

However, in the present embodiment, the heaters 17 are comprised of the first path portions 20 coaxial with the third tubular parts 11*c* and the second path portions 21 sticking out in ring shapes at the outside of the first path portions 20 in the radial direction.

For this reason, if the vapor of the working medium 12 is cooled by the coolers 19 and liquefies and the liquid level of the working medium 12 rises, first the liquid part of the working medium 12 will immediately enter the first path portions 20 in the heaters 17, strike the top end faces 20*a* of the first path portions 20, then change the displacement direction to the horizontal direction and enter the second path portions 21.

In this way, if the liquid part of the working medium 12 strikes the top end faces 20*a* of the first path portions 20, the liquid part of the working medium 12 will be agitated and turbulence caused. As a result, the thermal boundary layers formed inside the heaters 17 can be destroyed, so the heat transfer rate from the heaters 17 to the working medium 12 can be improved.

Further, in the present embodiment, the second path portions 21 extend in the horizontal direction, so the agitated liquid part of the working medium 12 can enter the second path portions 21 without going against gravity. For this reason, it becomes easy for the liquid part of the working medium 12 to enter the second path portions 21 while maintaining its agitated state, so the heat transfer rate from the heaters 17 to the working medium 12 can be improved more effectively.

Here, when connecting the heaters 17 and the vapor reservoirs 22 by just the second vapor passages 24, that is, when not providing the first vapor passages 23, since the second vapor passages 24 are arranged at the outer peripheries of the second path portions 21, the vapor of the working medium 12 generated near the top end faces 20*a* of the first path portions 20 has to pass through the second path portions 21 or else cannot be stored at the vapor reservoirs 22. That is, the vapor of the working medium 12 generated near the top end faces 20*a* of the first path portions 20 cannot be smoothly guided to the vapor reservoirs 22.

For this reason, when the vapor of the working medium 12 passes through the second path portions 21, it mixes with the liquid part of the working medium 12 in the second path portions 21 and forms bubbles and is cooled by the liquid part of the working medium 12 to end up being liquefied, so the amount of displacement of the working medium 12 is reduced by that amount and the output of the external combustion engine ends up dropping.

Considering this point, in the present embodiment, the heaters 17 and the vapor reservoirs 22 are connected not only by the second vapor passages 24, but also by the first vapor passages 23 arranged at the top end faces 20*a* of the first path portions 20, so as shown by the arrow b of FIG. 1, the vapor of the working medium 12 generated near the top end faces 20*a* of the first path portions 20 can be released through the first vapor passages 23 quickly to the vapor reservoirs 22.

For this reason, the vapor of the working medium 12 ending up mixing with the liquid part of the working medium 12 and forming bubbles can be suppressed, so the output of the external combustion engine can be improved.

Further, in the present embodiment, the first vapor passages 23 are arranged coaxially with the first path portions 20 and the first vapor passages 23 are parallel with the direction in which the first path portions 20 extend, so the direction by which the working medium 12 strikes the top end faces 20*a* and the direction in which the first vapor passages 23 extend can be made the same.

For this reason, the vapor of the working medium 12 generated near the top end faces 20*a* of the first path portions 20 can be released through the vapor passages 23 quickly to the vapor reservoirs 22. As a result, the vapor of the working medium 12 generated at the collision surfaces 20*a* ending up mixing with the liquid part of the working medium 12 and forming bubbles can be suppressed more, so the output of the external combustion engine can be improved more.

Note that in the present embodiment, the inside diameter d1 of the first vapor passages 23 is set to less than the inside diameter D of the first path portions 20 (d1<D), so even if providing the first vapor passages 23 at the top end faces of the first path portions 20, the working medium 12 can be made to collide with the top end faces of the first path portions 20 well.

Second Embodiment

Figure 3A:
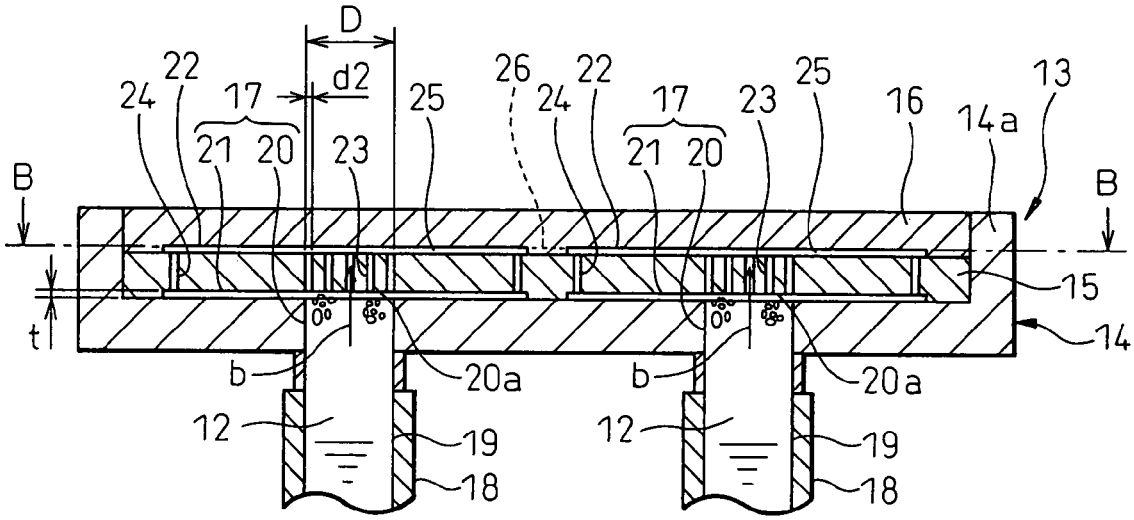
Figure 3B:
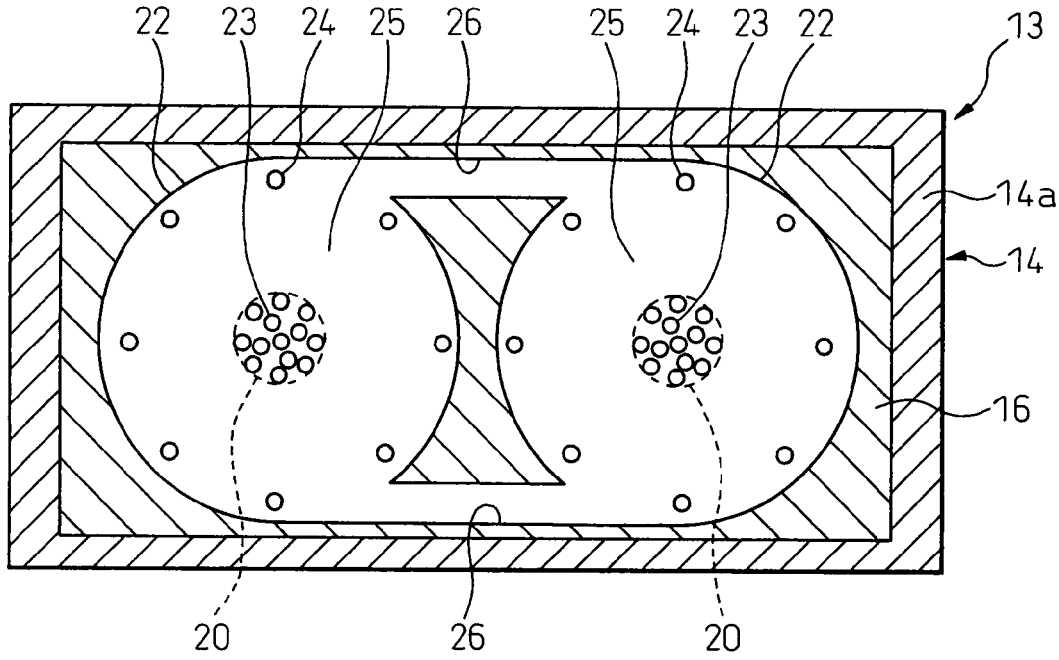
FIG. 3B is a cross-sectional view along the line B-B of FIG. 3A.

In the above first embodiment, the first vapor passages 23 were formed by single circular holes, but in the second embodiment, as shown in FIGS. 3A and 3B, the first vapor passages 23 are formed by large numbers of fine holes.

The inside diameter d2 of the large number of fine holes is set larger than the thickness dimension t of the second path portion 21 (d2>t). Due to this, the flow path resistance in the large number of fine holes can be made smaller than the flow path resistance in the second path portion 21, so the vapor of the working medium 12 generated near the top end faces of the first path portions 20 is guided to the first vapor passage 23 side rather than the second path portion 21 side.

As a result, the vapor of the working medium 12 generated near the top end faces of the first path portions 20 can be quickly released through the first vapor passages 23 to the vapor reservoirs 22, so effects the same as the above first embodiment can be exhibited.

Third Embodiment

Figure 4A:
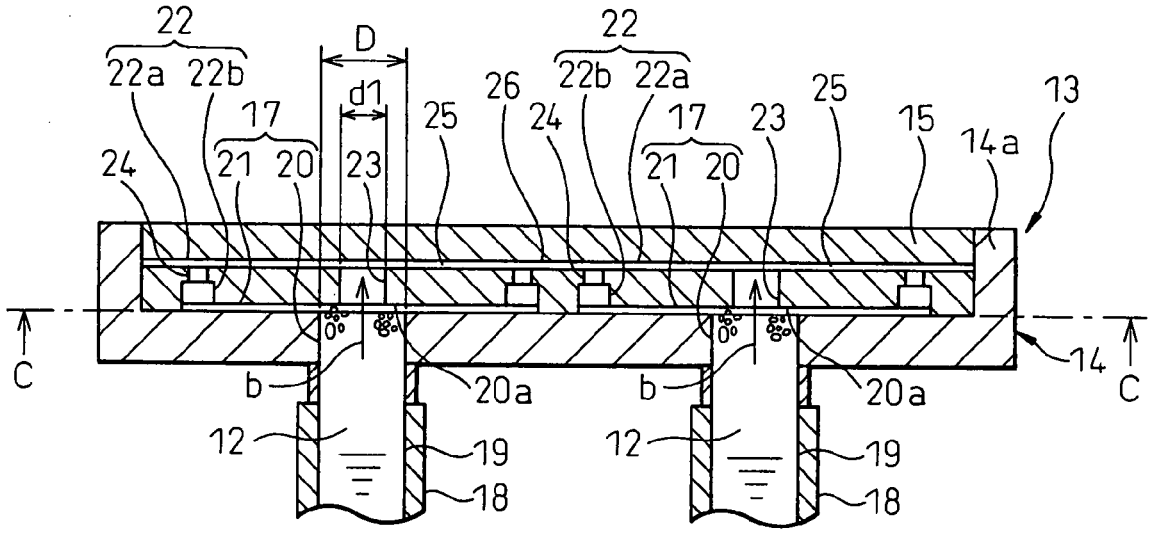
Figure 4B:
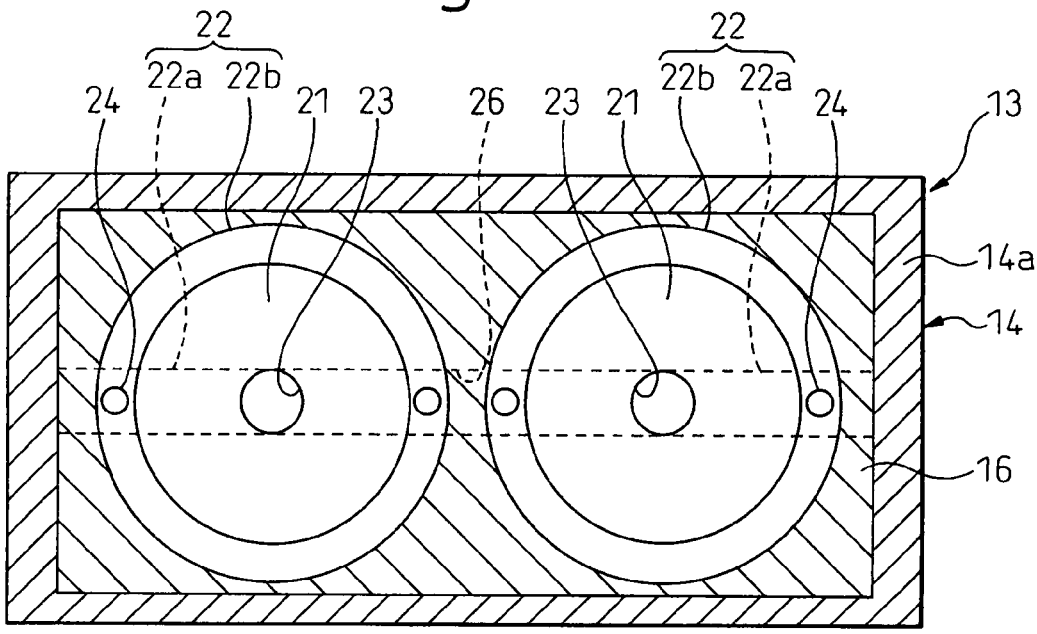
FIG. 4B is a cross-sectional view along the line C-C of FIG. 4A.

The third embodiment changes the shape of the vapor reservoirs 22 from the above first embodiment. FIG. 4A is a longitudinal cross-sectional view of the heaters 17 in the present embodiment, while FIG. 4B is a cross-sectional view along the line C-C of FIG. 4A.

In the present embodiment, each vapor reservoir 22 is comprised of a belt-shaped vapor reservoir 22*a* formed into a belt shape extending in parallel to the long side direction of the block member 13 above the first vapor passage 23 and a ring-shaped vapor reservoir 22*b* formed in a ring shape at the outer circumference of the second path portion 21 of the heater 17.

The belt-shaped vapor reservoir 22*a* is communicated with a heater 17 through the first vapor passage 23. The belt-shaped vapor reservoir 22*a* is arranged in parallel with the direction connecting the centers of the two first path portions 20 (left-right direction of FIG. 4B).

In the present embodiment, two second vapor passages 24 are arranged between the belt-shaped vapor reservoirs 22*a* and ring-shaped vapor reservoirs 22*b*. The second vapor passages 24 connect the belt-shaped vapor reservoirs 22*a* and the ring-shaped vapor reservoirs 22*b*.

Further, in the present embodiment, a single connecting passage 26 is arranged so as to connect the adjoining ends of the two belt-shaped vapor reservoirs 22*a*. Due to this, the two belt-shaped vapor reservoirs 22*a* and connecting passage 26 form a single belt shape as a whole.

In the present embodiment as well, similar effects as the above first embodiment can be exhibited.

Further, according to the present embodiment, the belt-shaped vapor reservoirs 22*a* are superposed with only part of the second path portions 21 when seen from above. For this reason, compared with the case like in the above embodiments where the vapor reservoirs 22 are superposed over the entire second path portions 21 when seen from above, the heat of the heat source (high temperature gas) is easily transmitted from above to the second path portions 21. For this reason, at the second path portions 21, the working medium 12 can be effectively heated.

Further, in the present embodiment, the two belt-shaped vapor reservoirs 22*a* and the connecting passage 26 form a single belt shape as a whole, so the block member 13 can be formed split into the first and second split members 21, 22.

More specifically, by forming a rectangular through holes extending in parallel to the long side direction in the second split member 15, it is possible to form the two belt-shaped vapor reservoirs 22*a* and the connecting passage 26. Further, if forming ring-shaped recessed shapes corresponding to the ring-shaped vapor reservoirs 22*b* and holes corresponding to the second vapor passages 24 in the second split member 15, it is possible to form heaters 17 and vapor reservoirs 22 etc. inside the block member 13.

For this reason, the structure of the block member 13 can be simplified and the cost can be reduced.

Fourth Embodiment

Figure 5A:
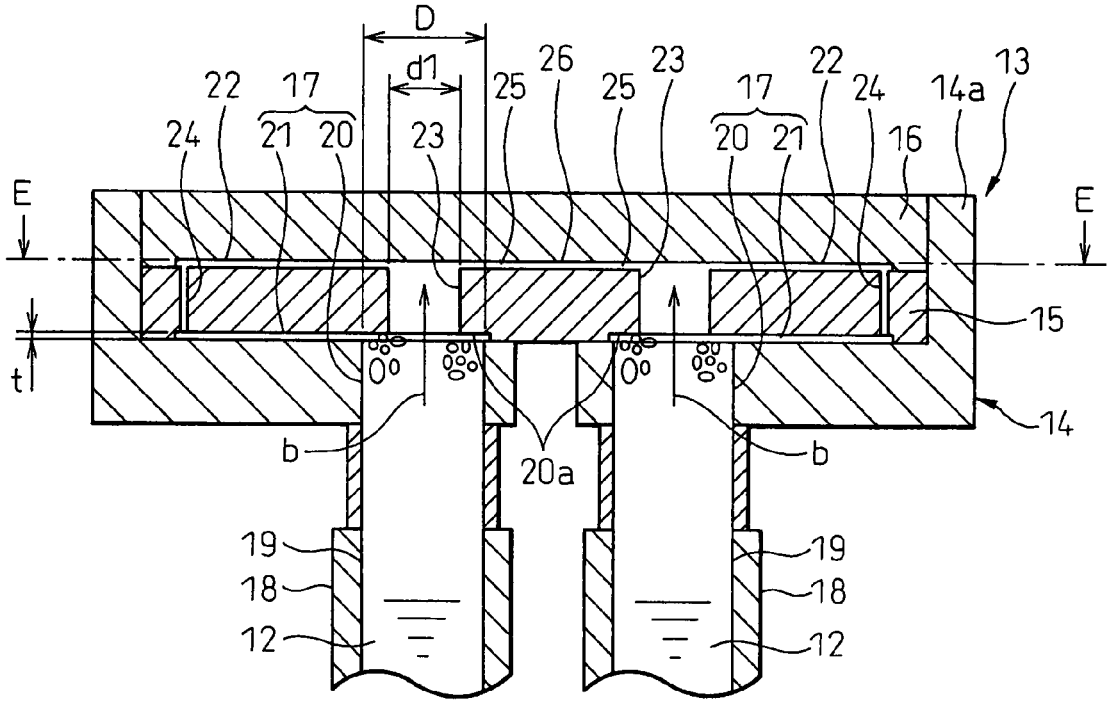
Figure 5B:
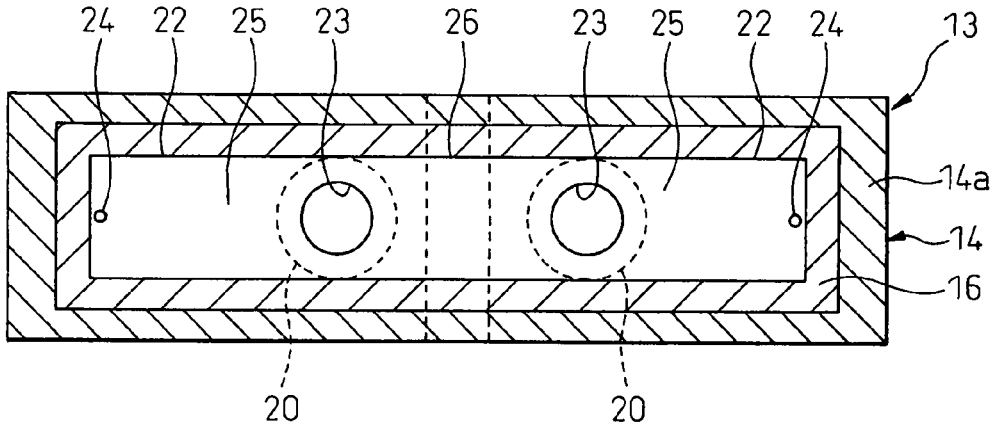
FIG. 5B is a cross-sectional view along the line E-E of FIG. 5A.

In the above embodiments, the second path portions 21 are formed in ring shapes sticking out to the outsides of the first path portions 20 in the radial direction and the vapor reservoirs 22 are formed in disk shapes facing the first path portions 20, but in the fourth embodiment, as shown in FIG. 5, the second path portions 21 are formed in belt shapes extending in directions perpendicular to the axial direction of the first path portions 20 and the vapor reservoirs 22 are formed in belt shapes facing the first path portions 20.

In the present embodiment, the thickness dimension t of the second path portions 21 is made smaller than the inside diameter D of the first path portions 20 and is set to be the heat penetration depth a or less (t<D and t<σ). Due to this, in the second path portions 21, the working medium 12 can be heated well.

A single second vapor passage 24 is formed so as to connect the end of the second path portion 21 at the opposite side to the first path portion 20 and the end of the vapor reservoir 22 at the opposite side to the first path portion 20.

A single connecting passage 26 is arranged so as to connect the adjoining ends of the two vapor reservoirs 22.

In the present embodiment as well, it is possible to exhibit effects similar to the above first embodiment.

Other Embodiments (1) In the above embodiments, the axial directions of the first path portions 20 and the directions of projection of the second path portions 21 perpendicularly intersect, but the invention is not limited to this. It is sufficient that the axial directions of the first path portions 20 and the directions of projection of the second path portions 21 be made to intersect.

(2) In the above embodiments, the first path portions 20 are formed by cylindrical surfaces, but the invention is not limited to this. For example, they may also be formed by angular cross-section tubes.

(3) The shapes of the second path portions 21 in the above embodiments (ring shapes and belt shapes) are examples and may be modified in various ways. For example, it is also possible to to form a large number sticking out radially from the first path portions 20. Further, they may also be formed sticking out from the first path portions 20 in circular cross-sectional shapes.

(4) In the above embodiments, two third tubular parts 11*c* were formed extending out upward from the second tubular part 11*b* and the heaters 17 were arranged above the coolers 19, but the two third tubular parts 11*c* may also be formed to extend from the second tubular part 11*b* downward and the heaters 17 may be arranged below the coolers 19.

(5) In the above embodiments, two third tubular parts 11*c* were arranged and two heaters 17 and coolers 19 were formed corresponding to the two third tubular parts 11*c*, but it is also possible to arrange three third tubular parts 11*c* and form three or more heaters 17 and coolers 19 corresponding to the three or more third tubular parts 11*c*.

(6) In the above embodiments, the coolers 19 were formed in the middle parts 18 of the third tubular parts 11*c*, but the coolers 19 may also be formed in the second tubular parts 11*b*.

(7) In the above embodiments, the heaters 17 were designed to be heated by high temperature gas, but the heaters 17 may also be heated by electrical heaters.

(8) The above embodiments show examples of application of the present invention to a drive source of a power generating unit, but the invention is not limited to this. The external combustion engine of the present invention may of course also be applied to drive sources of other than power generating units.

While the invention has been described with reference to specific embodiments chosen for purpose of illustration, it should be apparent that numerous modifications could be made thereto by those skilled in the art without departing from the basic concept and scope of the invention.

The invention claimed is:

1. An external combustion engine provided with a container in which a working medium is sealed flowable in a liquid state, the container being formed with a heater for heating part of a working medium to generate vapor of the working medium and a cooler for cooling the vapor to liquefy, the generation and liquefaction of the vapor causing the working medium to change in volume and the displacement of the liquid part of the working medium caused by the change in volume of the working medium being converted to mechanical energy for output, wherein at least the part of the container connected with the heater is branched into a plurality of tubular parts, a plurality of heaters are formed so as to be connected with the plurality of tubular parts, a plurality of vapor reservoirs for storing the vapor of the working medium are formed so as to be connected with the plurality of heaters, and the plurality of vapor reservoirs are connected with each other.

2. An external combustion engine as set forth in claim 1, wherein the heaters and the vapor reservoirs are formed in a single block member.

3. An external combustion engine as set forth in claim 1, wherein the plurality of heaters are arranged in the horizontal direction, the plurality of vapor reservoirs are arranged above the plurality of heaters, and a connecting passage connecting the plurality of vapor reservoirs extends in the horizontal direction between the plurality of vapor reservoirs.

4. An external combustion engine as set forth in claim 1, wherein each heater is comprised of a first path portion extending in a tubular shape at the side near the cooler and a second path portion sticking out in a ring shape in a direction perpendicular to the first path portion from the end of the first path portion at the side away from the cooler. The end face of the first path portion at the side away from the cooler forms the collision surface of the liquid part of the working medium.

5. An external combustion engine provided with a container in which a working medium is sealed flowable in a liquid state, the container being formed with heaters for heating part of a working medium to generate vapor of the working medium and coolers for cooling the vapor to liquefy, the generation and liquefaction of the vapor causing the working medium to change in volume and the displacement of the liquid part of the working medium caused by the change in volume of the working medium being converted to mechanical energy for output, wherein each heater has a vapor reservoir storing vapor arranged at it, each heater has a collision surface which the liquid part of the working medium strikes when the volume of the vapor is reduced and the liquid part of the working medium displaces from the cooler side toward the heater side formed at it, and each vapor reservoir is connected with the portion of the heater where the collision surface is formed.

6. An external combustion engine as set forth in claim 5, wherein each heater is formed by a first path portion extending toward said cooler side and a second path portion extending from an end of said first path portion at the opposite side to said cooler in a direction perpendicular to the direction in which said first path portion extends, the collision surface is formed at the end of the first path portion and the opposite side from the cooler, the vapor reservoir is arranged at the opposite side of the first path portion from the cooler, and the passage connecting the heater and the vapor reservoir extends in parallel between the collision surface and vapor reservoir in the direction in which the first path portion extends.

7. An external combustion engine as set forth in claim 5, wherein the inside diameter of the passage connecting each heater and vapor reservoir is set smaller than the inside diameter of the first path portion.

8. An external combustion engine as set forth in claim 5, wherein the passage connecting each heater and vapor reservoir is comprised of a large number of thin tubes.

* * * * *